US005467682A

United States Patent [19]

Brooks

[11] Patent Number: 5,467,682

[45] Date of Patent: Nov. 21, 1995

[54] ACTION CALIBRATION FOR FIRING UPON A FAST TARGET

[75] Inventor: Herbert B. Brooks, Claremont, Calif.

[73] Assignee: Hughes Missile Systems Company, Los Angeles, Calif.

[21] Appl. No.: 644,748

[22] Filed: Aug. 27, 1984

[51] Int. Cl.[6] ..... F41G 3/02; F41G 3/06

[52] U.S. Cl. ..... 89/41.22; 89/41.07; 89/41.17; 235/412; 342/67; 342/119; 364/423

[58] Field of Search ..... 89/41.05, 41.07, 89/41.14, 41.17, 41.19, 41.21, 41.22; 235/400, 404, 411, 412, 413, 414, 415, 416, 417; 343/7 G, 12 MD; 364/423; 342/67, 119

[56] References Cited

U.S. PATENT DOCUMENTS

| | | | |
|---|---|---|---|
| 2,409,462 | 10/1946 | Zworykin et al. | 89/41.07 |
| 2,463,233 | 3/1949 | Alexanderson | 89/41.07 |
| 3,063,047 | 11/1962 | Steele | 364/423 |
| 3,116,039 | 12/1963 | Goldberg | 89/41.07 |
| 3,135,053 | 6/1964 | Newman et al. | 343/7 G |
| 3,136,992 | 6/1964 | French | 89/41.07 |
| 3,686,478 | 8/1972 | Goldberg et al. | 235/417 |
| 3,733,465 | 5/1973 | Marasco | 235/417 |
| 3,739,152 | 6/1973 | Frohock, Jr. et al. | 235/417 |
| 3,743,818 | 7/1973 | Marasco et al. | 235/417 |
| 3,882,496 | 5/1975 | Lewis et al. | 343/7 G |
| 3,982,713 | 9/1976 | Martin | 235/417 |
| 4,015,258 | 3/1977 | Smith et al. | 343/7 G |
| 4,124,849 | 11/1978 | Zahornasky et al. | 343/7 G |
| 4,128,837 | 12/1978 | Page | 343/7 G |

FOREIGN PATENT DOCUMENTS

| | | | |
|---|---|---|---|
| 2452586 | 5/1975 | Germany | 343/7 G |

*Primary Examiner*—Stephen C. Bentley
*Attorney, Agent, or Firm*—Charles D. Brown; Randall M. Heald; Wanda K. Denson-Low

[57] ABSTRACT

A method for firing a computerized radar weapon system upon a fast target to reduce errors in aim caused by aim-biasing factors that vary in time and space includes computing a point along an extrapolated target track ahead of the target at which to stage an interception. A spotting round is fired at the point to zero-in just before the interception and then a correctly-aimed intercept round is fired at the point in time to make the interception. Additional interceptions may be staged at backup intercept points to guard against a miss, a burst of spotting rounds may be fired at an intercept point to average out perturbations in the trajectory of the projectile from each one of the rounds, and conventional monopulse radar methods of aim bias measurement may be employed to detect projectile miss information.

7 Claims, 3 Drawing Sheets

ACTION CALIBRATION FOR FIRING UPON A FAST TARGET

BACKGROUND OF THE INVENTION

This invention relates in general to radar weapon systems and pertains particularly to a method for firing a computerized radar weapon system upon a fast target.

Existing radar weapon systems, such as those commonly employed aboard ship, often include a computer system in combination with a gun system and a radar system for target tracking and closed-loop bullet (or other projectile) spotting. A target is fired upon by leading the target in the usual manner of firing at an intercept point ahead of the target according to target velocity and projectile flight time in an attempt to score a hit at the intercept point. The gun is aimed at the intercept point on the basis of predetermined corrections for various aim-biasing factors, such as wind and refraction, and if the target is missed the amount of the miss is measured and used to correct the aim for another attempt at another intercept point.

By this method, corrections to aim are made according to the estimated projectile trajectory.

Although effective in many respects, the foregoing method has certain limitations. For example, some fast targets, such as anti-ship missiles, have speeds of the same order of magnitude as the projectiles fired against them. When firing upon such fast targets, the target travels a considerable distance between its position when the projectile is fired and the intercept point, as well as traveling a considerable distance between two successive intercept points. Since variations often occur in aim-biasing factors from one point to another, corrections made for a miss at one of the intercept points are often in error for the other intercept point, and the target is missed again.

Furthermore, since some aim-biasing factors such as wind vary with time, predetermined corrections may be in error by the time the target is fired upon.

Thus, when engaging a fast-approaching threat, the net result of existing closed-loop aim bias correction methods is to transfer to closer range, the errors unavoidably encountered in target-tracking and projectile-spotting at long range.

One such long-range error is caused by multipath reflections of the radar signal from the underlying surface, Barton, D. K., "Low Angle Radar Tracking", Proc. IEEE, June 1974, v. 62 No. 6, pp 687–704. Another is the effect of clutter and jamming. It can be taken as a general rule that tracking errors are greater at longer ranges.

Consequently, it is desirable to have a new method for firing a radar weapon system upon a fast target.

It is desirable to have a method that compensates for or reduces susceptibility to time-dependent variations in aim-biasing factors.

It is desirable to have a method that compensates for or reduces susceptibility to space-dependent variations in aim-biasing factors.

It is desirable to have a method that does not transfer long-range tracking errors to closer-range firing.

And, it is desirable to have a method readily adaptable to existing radar weapon systems.

SUMMARY OF THE INVENTION

This invention provides a superior method for firing a computerized radar weapon system upon a fast target.

An exemplary procedure according to the invention includes computing an intercept point along an extrapolated target track ahead of a target to be fired upon at which to stage an interception. A spotting round is aimed and fired at the point in order to zero in just before the interception, and then a correctly-aimed intercept round is fired at the point in time to make the interception.

By making corrections in aim at the time and place of the interception to follow, aim-correction errors otherwise introduced by time-dependent and space-dependent variations in aim-biasing factors are minimized.

Other features and many attendant advantages of the invention will become more apparent upon a reading of the detailed description together with the drawings, wherein like reference numerals refer to like parts throughout.

DETAILED DESCRIPTION

Figure 1:
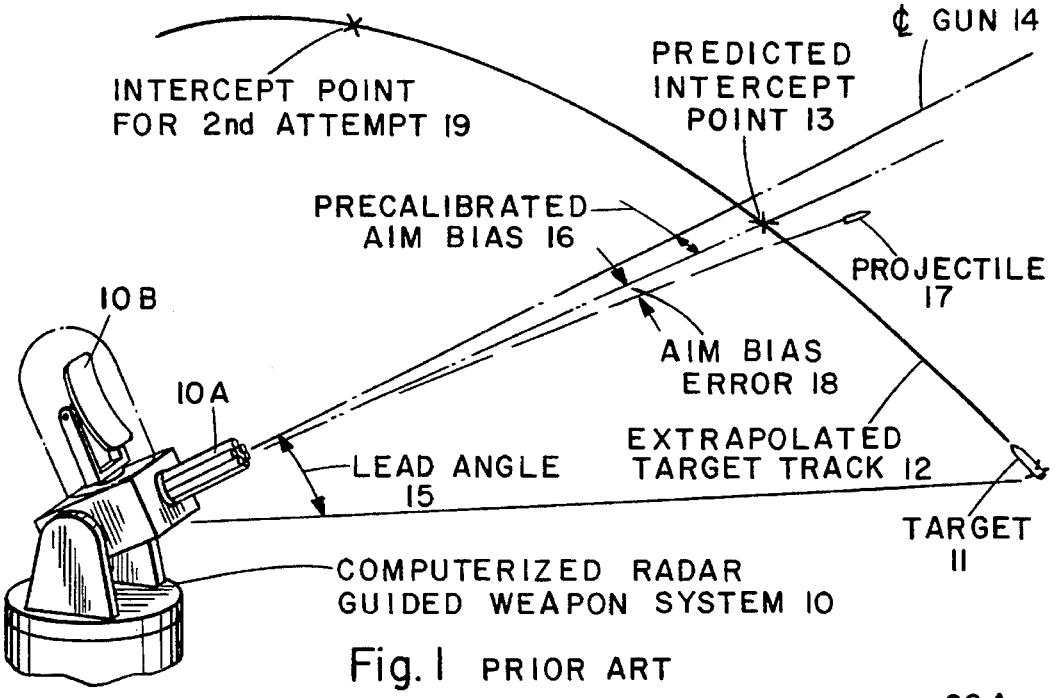
Fig. 1 PRIOR ART
FIG. 1 is a pictorial illustration of the prior art method of leading the target.
Figure 2:
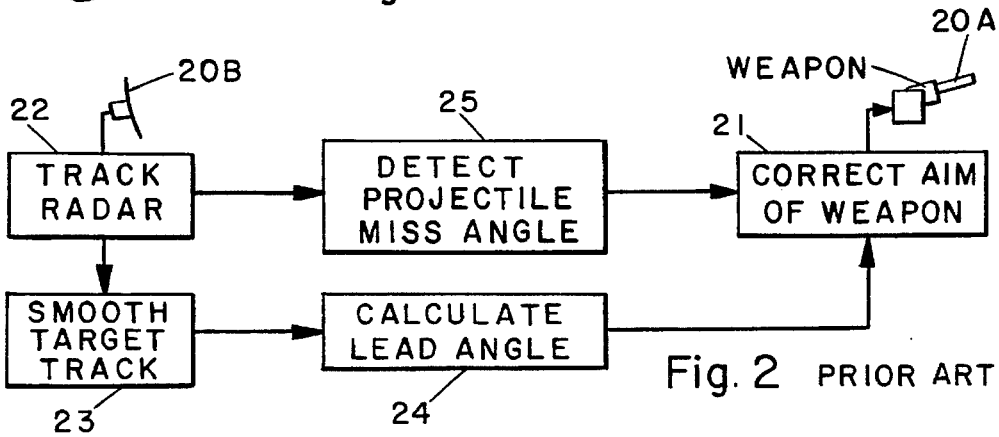
Fig. 2 PRIOR ART
FIG. 2 is a block diagram of a prior art system.
Figure 3:
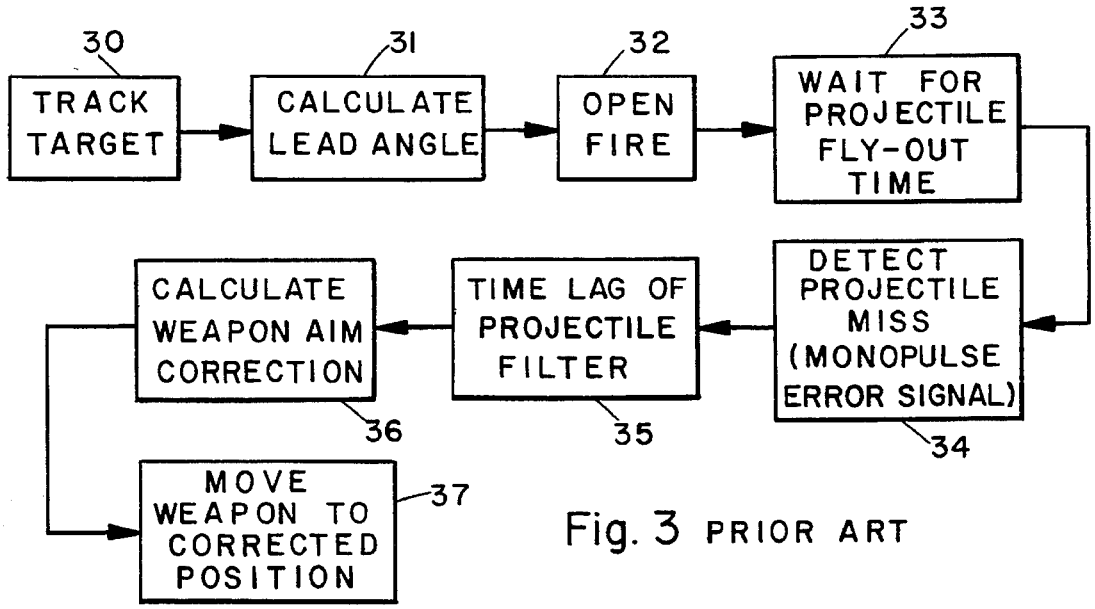
Fig. 3 PRIOR ART
FIG. 3 is a flow chart of the prior art method.

The prior art method of firing a computerized radar weapon system upon a target is illustrated in FIGS. 1–3. Computerized radar weapon system 10 in FIG. 1 illustrates the prior art method of firing upon target 11 by leading the target in the usual manner of firing at predicted intercept point 13 ahead of the target according to target velocity and bullet (or other projectile) flight time in an attempt to score a hit at the intercept point.

Weapon system 10 represents a conventional system such as those commonly employed aboard ship that includes a computer system in combination with a gun system and a radar system for closed-loop spotting. Cannon 10A represents a gun system and antenna 10B represents a radar system. A computer system is not illustrated, but it would be functionally interconnected with the gun and radar in an actual prior art system.

Target 11 is fired upon by first computing extrapolated target track 12 for the target using conventional methods of tracking the target and computing a path that the target is expected to follow.

Along the extrapolated target track, ahead of the target, predicted intercept point 13 is computed according to target velocity and projectile flight time with the intention of firing at the predicted intercept point to intercept the target.

Weapon system 10 is aimed so that the center line of the weapon system's gun, designated reference numeral 14 in FIG. 1, leads target 11 by lead angle 15 according to precalibrated aim bias 16. The precalibrated aim bias is determined prior to engaging the target, and it is derived using known methods of aim adjustment to compensate for deviations in a projectile trajectory caused by various environmental factors such as wind. A round of ammunition is then fired in an attempt to intercept the target at predicted intercept point 13 with the projectile fired from the round, projectile 17 in FIG. 1.

By this prior art method, the flight of projectile 17 is measured with the radar of weapon system 10. A miss may be thereby detected and aim bias error 18 calculated as an indicator of how much precalibrated bias 16 was in error. The prior art method then proceeds by computing an intercept point for a second attempt, designated reference numeral 19 in FIG. 1, and the procedure is repeated with corrections made to precalibrated aim bias 16 according to aim bias error 18.

Thus, the prior art measures the actual projectile miss information and corrects the aim accordingly for another attempt at another intercept point.

FIG. 2 shows a functional block diagram of a computerized radar-guided weapon system employing the prior art method illustrated in FIG. 1. Weapon 20A and antenna 20B represent corresponding components of a computerized radar weapon system. Weapon 20A is controlled by a control system which includes the function represented by block 21 of correcting the aim of the weapon according to information derived from a track radar, block 22. The track radar functions both to track targets and detect projectile misses. Block 23 and block 24 illustrate functions related to target tracking. The target track is smoothed and a lead angle calculated using known methods, and this information is supplied to block 21 and weapon 20A is aimed accordingly.

After having once fired upon a target, the track radar is used to detect the miss of the projectile. Block 25 represents the function of detecting the miss angle and miss distance of the projectile. This information is supplied to block 21 and the aim of weapon 20A is refined accordingly in preparation for firing the next round.

FIG. 3 is a flow chart of the prior art method. Step 30 illustrates the step of tracking the target. Step 31 includes computation of an extrapolated target track, the selection of a predicted intercept point therealong, the calculation of a lead angle according to precalibrated aim bias, and aiming of the weapon accordingly.

Step 32 illustrates the firing of a round to intercept the target. Step 33 represents the interval of time waited for the projectile from the round to reach the predicted intercept point, and step 34 represents monopulse radar measurement of the projectile miss as it reaches the predicted intercept point.

Step 35 represents the time lag involved in the projectile detection and filtering process associated with conventional monopulse radar measurement, and step 36 represents the calculation of weapon aim correction based upon the trajectory of the projectile.

Finally step 37 illustrates the repositioning of the weapon to fire at other predicted intercept point according to aim bias corrections calculated from information measured at the previous intercept point.

Accordingly, the prior art method measures the amount of a miss at a predicted intercept point for use in calculating aim adjustments that will be used when firing at another predicted intercept point further along the target track.

Figure 4:
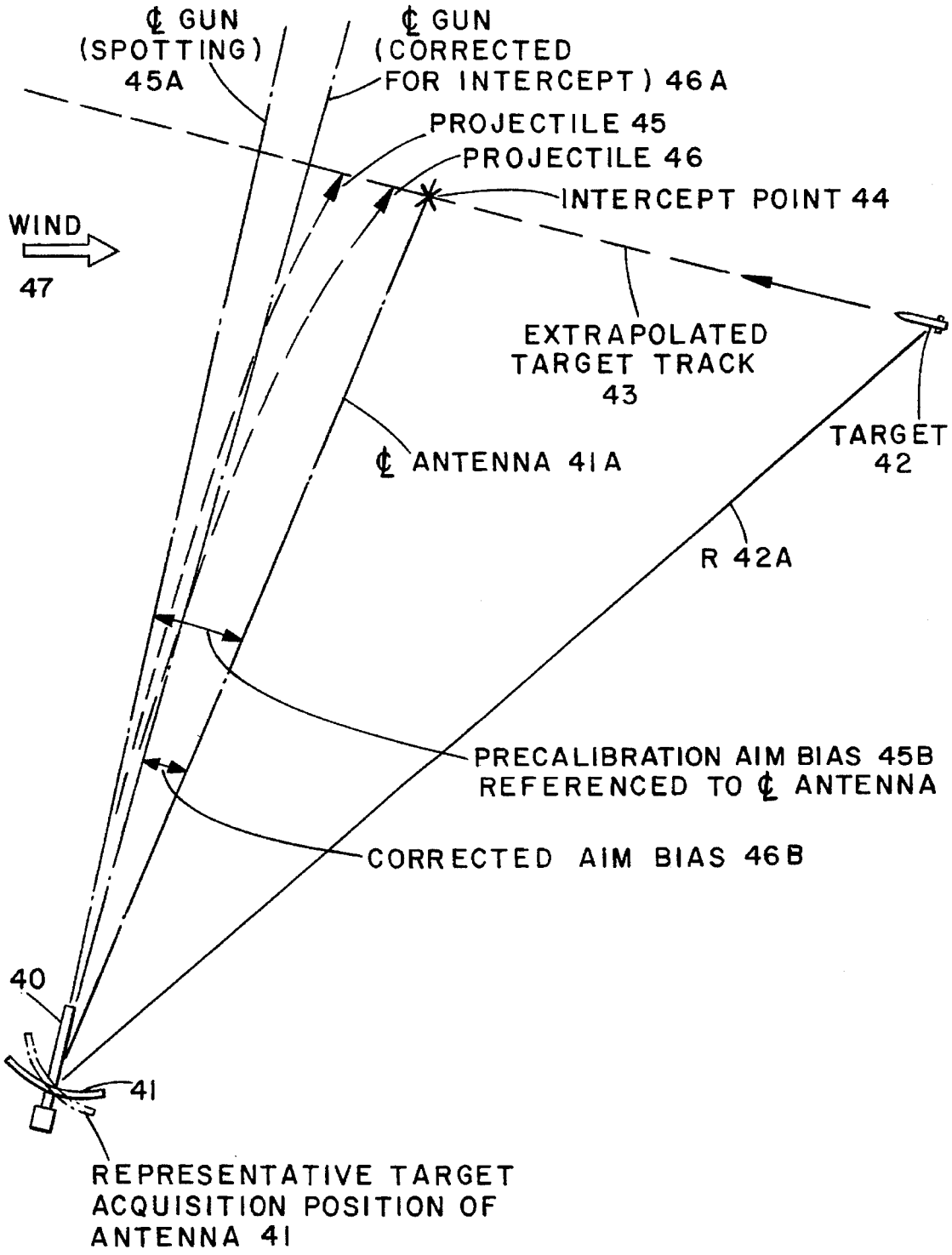
FIG. 4 is a pictorial illustration of exemplary procedures for firing a computerized radar weapon system according to this invention.
Figure 5:
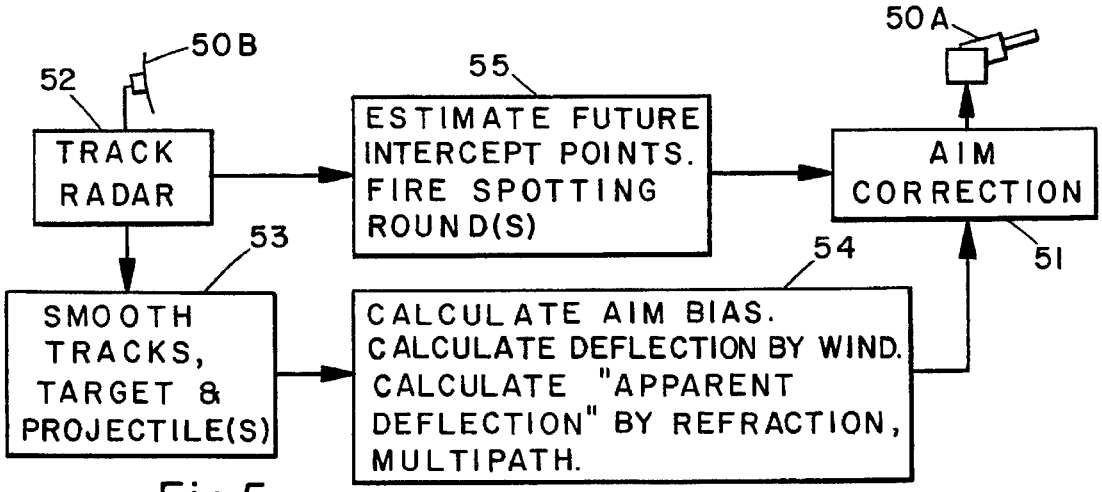
FIG. 5 is a block diagram of a computerized radar system employing the method of this invention.
Figure 6:
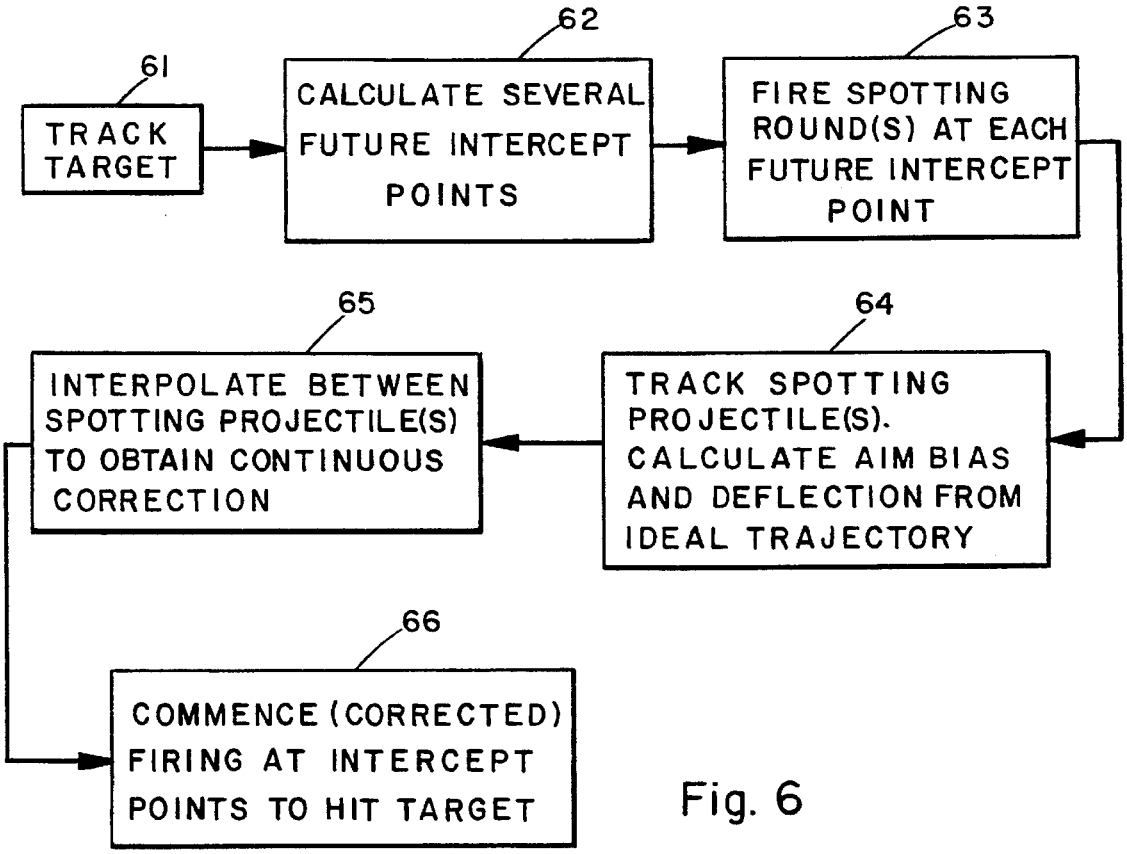
FIG. 6 is a flow diagram of exemplary procedures according to the invention.

Turning now to FIGS. 4–6, there is illustrated exemplary procedures for firing a computerized radar weapon system according to this invention. In the diagram of FIG. 4, gun 40 and radar 41 combine to fire upon target 42.

According to the method of this invention, target 42 is detected at some range, 42A in FIG. 4, and a point is computed ahead of the target at which to stage an interception. Radar 41 is a fire control radar system the known type, and the associated antenna is shown in dotted lines in a position it might occupy when detecting the target. This intercept point is computed using the computer system by first computing, extrapolated target track 43, representing the predicted path that target 42 will follow. The extrapolated target track is calculated using known means of computerized fire control, and along the extrapolated target track ahead of target 42 there is computed intercept point 44. It is the intercept point at which the interception will be staged. It is chosen sufficiently ahead of the target to allow time for staging and executing the interception.

The interception is staged and executed according to the method of this invention by first zeroing in on the intercept point with a spotting round just before the interception. This step is illustrated in FIG. 4 by projectile 45 which represents a projectile fired from the spotting round toward the intercept point. The spotting round is a conventional round of ammunition in the general sense of the word, and it is fired from a conventional gun, gun 40. Gun 40 is aimed with its center line along the direction designated by reference numeral 45A. This direction is chosen with reference to antenna center line 41A (which by this time has been directed at the intercept point as illustrated) according to precalibrated aim bias 45B in much the same manner as a weapon was aimed according to the prior art illustrated in FIGS. 1–3 to fire upon the first intercept point.

Radar 41 is a conventional radar system, and it tracks projectile 45 using known means such as monopulse radar tracking. The projectile-track data are then processed to derive the best aim-bias correction using suitable means such as a suitably programmed computer system in conjunction with the radar system. The measured deviation of projectile 45 from a ballistic path is important information. Such deviation would indicate a variation of the wind, or other error-producing influence, from the nominal value used in the initial calculation. This information is used in computing a corrected aim bias for subsequent rounds according to known means of computerized fire control.

One method of determining the trajectory of projectile 45 is to detect the point at which the projectile impacts the earth or water surface by detecting the point at which radar signals from the projectile disappear. An impact on the surface of water can be detected by detecting the splash associated with the impact. A trajectory determined in this manner can be compared to an ideal trajectory that is calculated in a conventional manner, based upon the position of the gun centerline, and corrections in aim made accordingly. An ideal trajectory can also be computer based upon the initial flight path (say 200 feet, for example) of the projectile as it leaves the gun barrel. By this second method, the initial projectile flight path (initial trajectory) is tracked using known means of radar tracking, and the ideal trajectory calculated accordingly with the computer system and suitable programming.

The method of this invention proceeds by firing a correctly-aimed intercept round at the intercept point in time to make the interception. This step is illustrated in FIG. 4 by projectile 46. Projectile 46 is fired from the intercept round while aiming with the gun center line in the direction designated by reference numeral 46A according to corrected aim bias 46B. The correctly-aimed round is fired at the correct time, allowing for target velocity and projectile flight time, to intercept the target at the intercept point. Since the zeroing in process refines the aim without necessarily perfecting it, projectile 46 is illustrated in FIG. 4 slightly missing the intercept point.

Thus, the method of this invention employs an existing computerized radar weapon system, that is suitably programmed using known means, to zero-in a weapon toward the planned intercept point just before firing for interception to thereby reduce errors in aim caused by aim-biasing factors that vary in time and space.

In FIG. 4 an arrow designated reference numeral 47 is shown to illustrate wind as one such aim-biasing factor. The amount of aim bias caused by wind varies in both time and space, and by firing a spotting round to zero-in on the intercept point followed by a correctly-aimed intercept round the effect on aim of time-dependent and space-dependent variations in the wind are minimized.

The block diagram of FIG. 5 illustrates functional interrelationships of a system employing the method of this invention. Accordingly, gun 50A is correctly aimed by a control system as illustrated by the block designated with reference numeral 51 according to information received from tracking radar 52 as illustrated by the combination of block 53 and block 54. A computerized tracking radar tracks a target to be fired upon as well as projectiles from rounds that are fired. The correct aim bias for firing upon each intercept point is calculated to offset such factors as deflection by wind, apparent deflection by refraction and multipath. After zeroing in on the intercept point, the aim of gun 50A is corrected accordingly to fire upon the target.

Block 55 illustrates another aspect of the invention. In the event the interception is unsuccessful, additional spaced-apart intercept points are calculated ahead of the target along the predicted target track. One or more spotting rounds are fired at each of these intercept points and aim bias corrections are computed for use in firing one or more correctly-aimed intercept rounds at the additional intercept points.

FIG. 6 is a flow diagram of exemplary procedures for firing upon a fast target according to the method of this invention. Step 61 illustrates a tracking radar tracking a target to be fired upon. An extrapolated target track is computed for the target and several future intercept positions computed therealong according to step 62.

One or more spotting rounds are fired at each of the intercept points to zero-in (step 63). A burst of spotting rounds (two or more) may be fired at each of the intercept points in order to average out perturbations in the trajectory of each of the projectiles. The projectiles from the spotting rounds are tracked, any miss detected, and aim-bias corrections computed (step 64). Where more than one spotting round is fired, it is necessary to time-share the tracker in order to track the projectiles from the spotting rounds while also tracking the target.

During the zeroing-in procedure, the target is continually (or repeatedly on a time-share basis) tracked and adjustments made as necessary according to any changes detected in the extrapolated target track (step 65).

Finally, as illustrated for step 66, at the appropriate time dependent upon target velocity and bullet flight time and system delays in aiming and firing, an intercept round is fired at each intercept point in succession to intercept the target.

Thus, by choosing an intercept point far enough ahead of the target to allow time to zero in with a spotting round before firing for interception, the method of this invention minimizes aim-bias correction errors that hinder prior art efforts to fire upon a fast target.

Furthermore, this invention avoids transferring long-range tracking errors to closer range.

Another advantage of the invention is quicker response after a target is identified, and to target maneuvers. The time-lags for the flight time of projectiles from spotting rounds, for processing the data, and for moving the weapon are not included in the tracking and aiming loop. The quick response of this invention is especially important in firing upon fast targets in those cases where the maximum range of detecting and/or tracking the target is limited because of propagation difficulties (e.g. horizon, or rain attenuation) and/or jamming.

As various changes may be made in the form, construction, and arrangement of the procedures and parts described herein, without departing from the spirit and scope of the invention and without sacrificing any of its advantages, it is to be understood that all matter herein is to be interpreted as illustrative and not in any limiting sense.

What is claimed is:

1. A method for firing a computerized radar weapon system upon a fast target, which comprises;

computing an intercept point ahead of the target at which to stage an interception;

computing an extrapolated target track for the target along which to stage the interception;

computing an intercept point on the extrapolated track that is ahead of the target by a distance corresponding to the sum of the time required to aim and fire a spotting round at the intercept point, the time required for a projectile from the spotting round to reach the intercept point after being fired, the time required to measure and analyze the aim of the spotting round, the time required to fire a correctly-aimed intercept round, and the time required for a projectile from the intercept round to reach the intercept point;

zeroing in on the intercept point with a spotting round before the interception; and then firing a correctly-aimed round at the point in time to make the interception;

thereby reducing errors in aim caused by aim-biasing factors that vary in time and space.

2. The method recited in claim 1 which includes revising the extrapolated target track and recomputing the intercept point immediately prior to aiming and firing the intercept round.

3. The method recited in claim 1 which includes computing a plurality of spaced-apart intercept points ahead of the target at which to stage a corresponding plurality of interceptions.

4. The method recited in claim 1 which includes determining a trajectory of a projectile from the spotting round by measuring a point at which the projectile impacts the earth or water.

5. The method recited in claim 4 which includes detecting a point at which the projectile impacts the earth or water by detecting a point at which radar signals from the projectile disappear.

6. The method recited in claim 4 which includes detecting a point at which the projectile impacts water by detecting a splash in the water surface.

7. The method recited in claim 1 which includes calculating an ideal trajectory for a projectile by measuring the initial trajectory of the projectile as it is fired.

* * * * *